US006848540B2

(12) United States Patent
Kvam

(10) Patent No.: US 6,848,540 B2
(45) Date of Patent: Feb. 1, 2005

(54) LADDER ACCESSORY HOLDER

(75) Inventor: Kevin L. Kvam, 855 Lone Eagle Dr., Chanhassen, MN (US) 55317

(73) Assignee: Kevin L. Kvam, Chanhassen, MN (US)

( * ) Notice: Subject to any disclaimer, the term of this patent is extended or adjusted under 35 U.S.C. 154(b) by 0 days.

(21) Appl. No.: 10/443,322

(22) Filed: May 21, 2003

(65) Prior Publication Data

US 2003/0196855 A1 Oct. 23, 2003

Related U.S. Application Data

(63) Continuation-in-part of application No. 09/854,808, filed on May 14, 2001, now abandoned.

(51) Int. Cl.[7] ..... E04G 1/00; E06C 7/16; E06C 7/14

(52) U.S. Cl. ..... 182/129; 182/121; 248/211

(58) Field of Search ..... 182/107, 214, 182/129, 206, 121; 248/210, 238, 211, 235

(56) References Cited

U.S. PATENT DOCUMENTS

| | | | | |
|---|---|---|---|---|
| 2,439,430 A | * | 4/1948 | Hurd | 182/206 |
| 3,895,772 A | | 7/1975 | Ellingson | |
| 4,017,047 A | | 4/1977 | Brogdon, Jr. et al. | |
| D266,964 S | | 11/1982 | Rasheed | |
| 4,359,138 A | | 11/1982 | Kummerlin et al. | |
| 4,433,822 A | * | 2/1984 | Caggiano | 248/210 |
| 4,450,935 A | * | 5/1984 | Gustavus | 182/121 |
| 4,730,697 A | | 3/1988 | Campbell | |
| 4,776,550 A | | 10/1988 | Storey | |
| D313,169 S | | 12/1990 | Scott et al. | |
| 5,305,977 A | | 4/1994 | Roth | |
| 5,421,428 A | | 6/1995 | Ingles | |
| 5,507,363 A | | 4/1996 | Tredup | |
| 5,716,034 A | | 2/1998 | Unkefer | |
| D393,413 S | | 4/1998 | Brown | |
| 6,241,204 B1 | | 6/2001 | Bermes | |
| 6,250,595 B1 | | 6/2001 | Campbell | |

FOREIGN PATENT DOCUMENTS

| | | |
|---|---|---|
| DE | 3704391 A1 | 8/1988 |
| DE | 4041428 A1 | 7/1991 |

* cited by examiner

*Primary Examiner*—Hugh B. Thompson, II
(74) *Attorney, Agent, or Firm*—Briggs and Morgan, P.A.

(57) ABSTRACT

An apparatus for attachment to the rungs of a ladder to securely hold a bucket and other accessories. The apparatus is readily detachable from the ladder rungs for movement along the ladder. The apparatus includes engagement members for gripping the ladder rungs and a spring for biasing the engagement members against the ladder rungs. The apparatus may have a pivotable arm to which a variety of accessories may be attached.

23 Claims, 7 Drawing Sheets

LADDER ACCESSORY HOLDER

The present application is a continuation-in-part of U.S. patent application Ser. No. 09/854,808, filed May 14, 2001 now abandoned. The present application relates to a device adapted to be removably and securely attached between the rungs of a ladder, in order to hold a bucket or other object.

BACKGROUND OF THE INVENTION

A number of U.S. patents disclose devices for attaching to ladders in order to support buckets. Such devices generally fall into two types.

A first type is attached to the rail of the ladder, as illustrated in U.S. Pat. Nos. D313,169; 4,776,550; and 5,305,977. These devices share a common deficiency in that the device cannot be easily moved up the ladder as the painter climbs the ladder without completely detaching the device from the rail, because the ladder rungs prevent movement of the device along the rail.

A second type is attached to a rung of the ladder, as illustrated in U.S. Pat. Nos. D266,964; D393,413; 3,895,772; 5,305,977; and 5,716,034. However, with the exception of U.S. Pat. No. 5,305,977, these patents do not disclose a means for securely attaching the bucket to the ladder rung, i.e., they all rely on gravity to keep the bucket attached to the rung. U.S. Pat. No. 5,305,977 discloses a hook for engaging a ladder rung and a spring for securing the hook in place; however, the design would allow the hook to rotate around the rung under the moment of inertia of the paint bucket.

There is a need for a device that can be easily attached to a ladder to hold a bucket and other attachments, that can be secured in place, and that can be easily removed from the ladder to move along the ladder with the painter or other person climbing the ladder.

SUMMARY OF THE INVENTION

Apparatus for attachment to the rungs of a ladder for securely holding a bucket and other accessories, the apparatus being readily detachable from the ladder rungs for movement along the ladder, the apparatus comprising:

a) a lower engagement member adapted to engage a ladder rung;

b) an upper engagement member adapted to engage an adjacent ladder rung; and c) an spring biasing the lower engagement member and upper engagement member against the respective ladder rungs.

A principal object and advantage of the present invention is that is securely attachable to each of two adjacent rungs of a ladder, and therefore cannot move either vertically or horizontally.

Another principle object and advantage of the present invention is that it is easily detachable from the ladder rungs so that the person climbing the ladder may move the apparatus to ladder rungs further up the ladder.

Another principle object and advantage of the present invention is that it is spring-biased between adjacent ladder rungs in such a way that it can be removed and moved along the ladder with only one hand.

Another object and advantage of the present invention is that it may include a pivoting arm which can be used to attach a variety of accessories, such as a bucket holder, bucket, hook, and gripper.

Another object and advantage of the present invention is that it may include a footrest attached to the apparatus.

DETAILED DESCRIPTION OF THE PREFERRED EMBODIMENT

Figure 1:
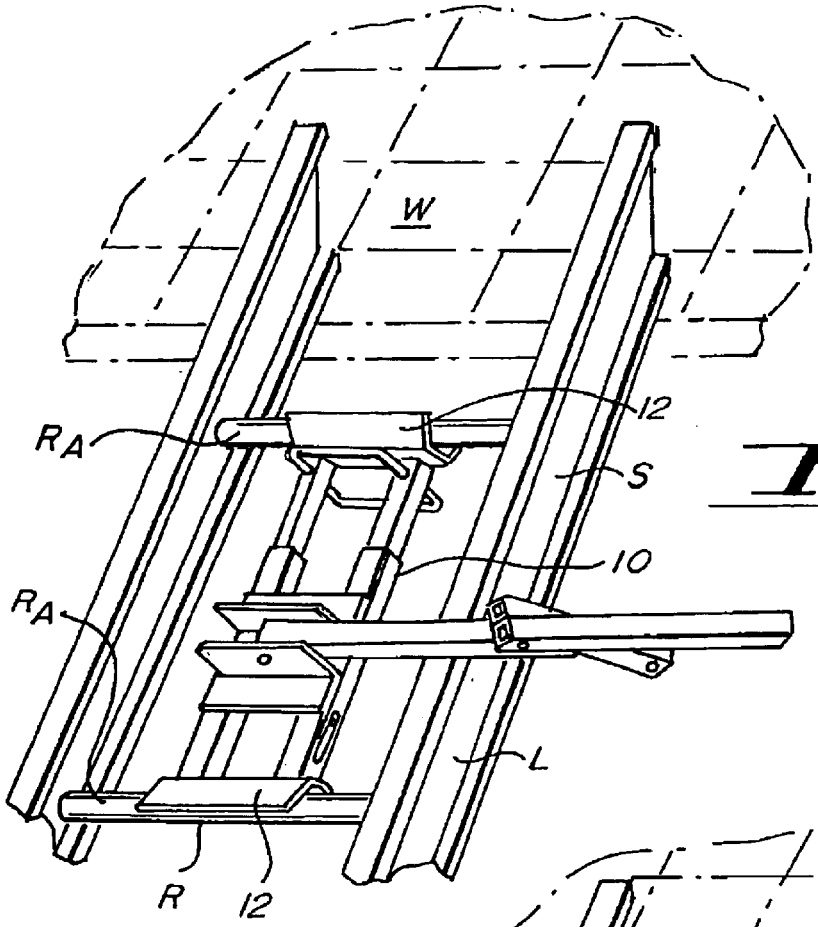
FIG. 1 is a perspective view of a ladder with a first embodiment of the invention attached thereto.
Figure 2:
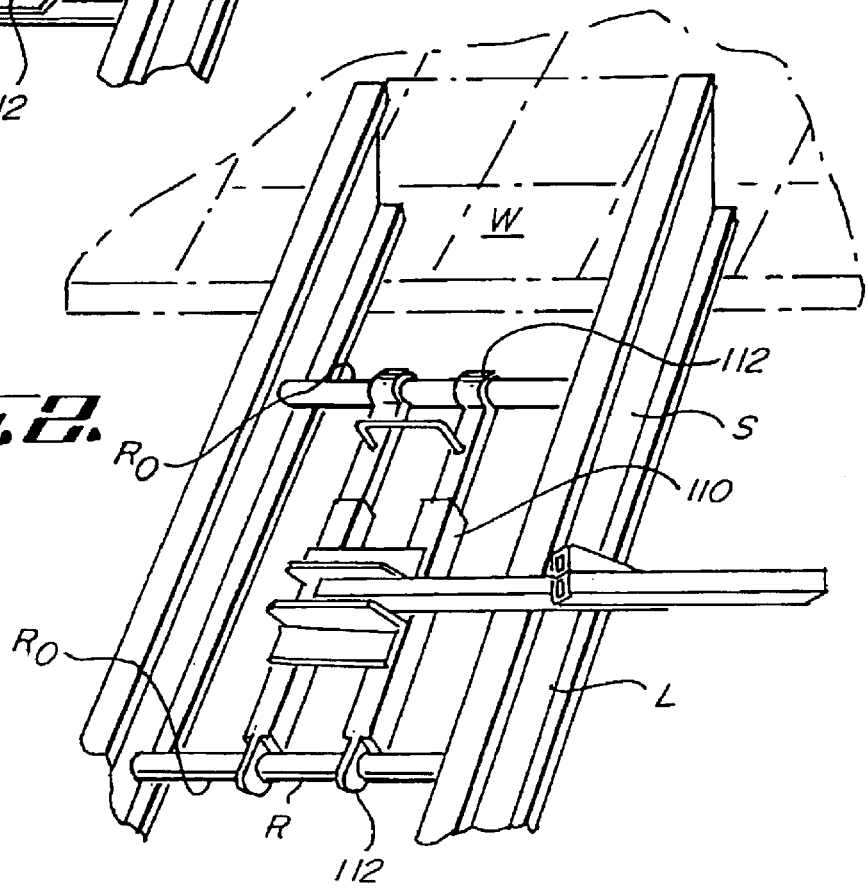
FIG. 2 is the same as FIG. 1, but with a second embodiment of the invention attached thereto.

FIGS. 1 and 2 show a ladder L leaning against a wall W. The ladder L has rungs R and side rails S.

In this Detailed Description, the terms "upper" and "lower" shall refer to orientations in which the invention is attached to a ladder which is resting more or less upright against a wall or other support.

A first embodiment of the apparatus 10 of the present invention is shown attached to the ladder L in FIG. 1. In the first embodiment, the apparatus 10 attaches between the rungs R by means of engagement members 12 that contact adjacent sides RA of the rungs R.

A second embodiment 110 of the present invention is shown attached to the ladder in FIG. 2. In the second embodiment, the apparatus 110 attaches between the rungs R by means of engagement members 112 that contact non-adjacent sides RO of the rungs R.

Figure 3:
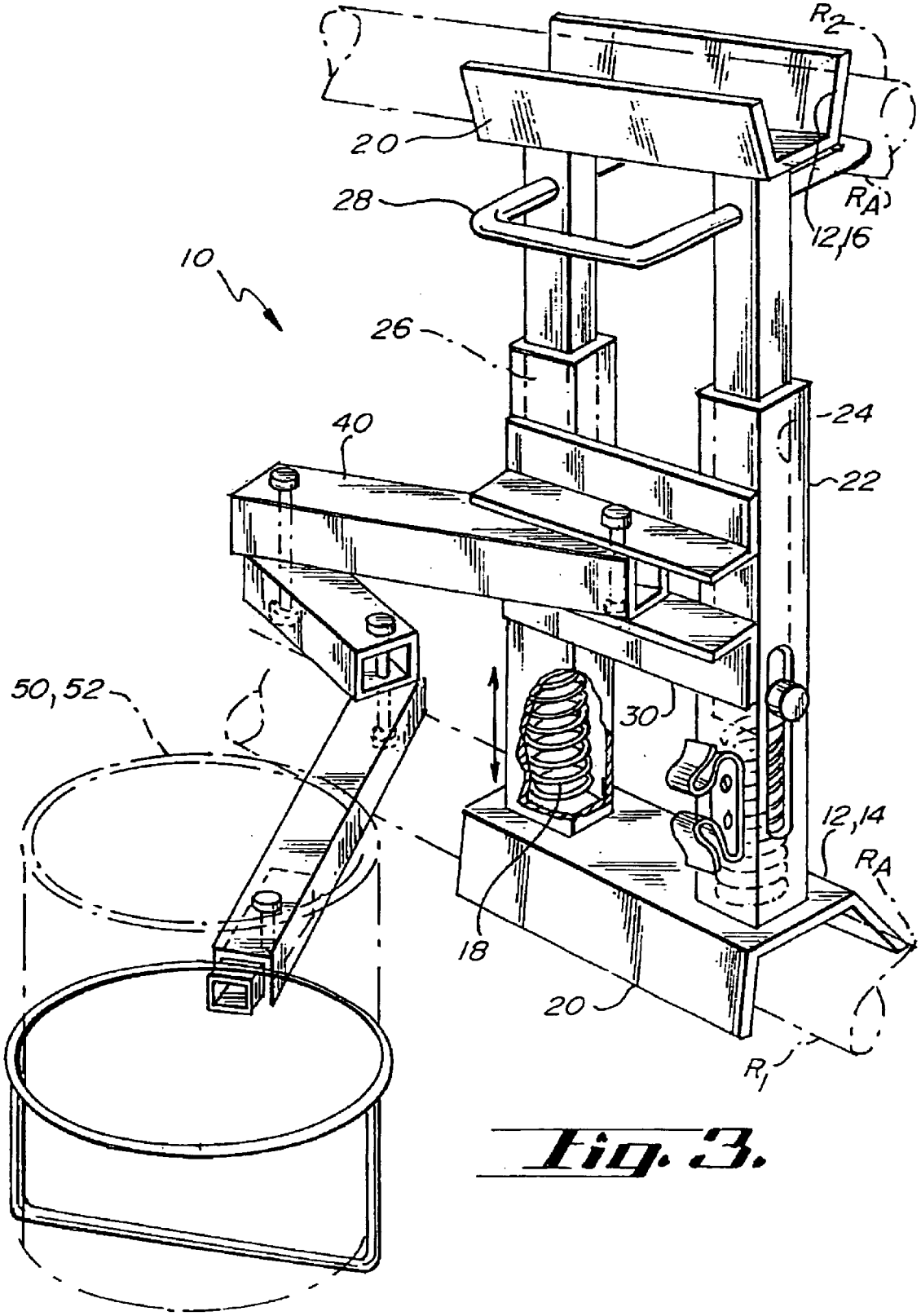
FIG. 3 is a perspective view of a first embodiment of the invention, with ladder rungs shown in phantom.

Details of the first embodiment 10 are shown in FIG. 3. The apparatus 10 further comprises a lower engagement member 14 adapted to engage ladder rung R1 and an upper engagement member 16 adapted to engage adjacent rung R2. The apparatus 10 also comprises a spring 18 biasing the lower engagement member 14 and the upper engagement member 16 against the rungs R1, R2.

The lower engagement member 14 and upper engagement member 16 preferably comprise U-shaped channels 20 adapted to contact the ladder rungs on the adjacent sides RA.

Figure 8:
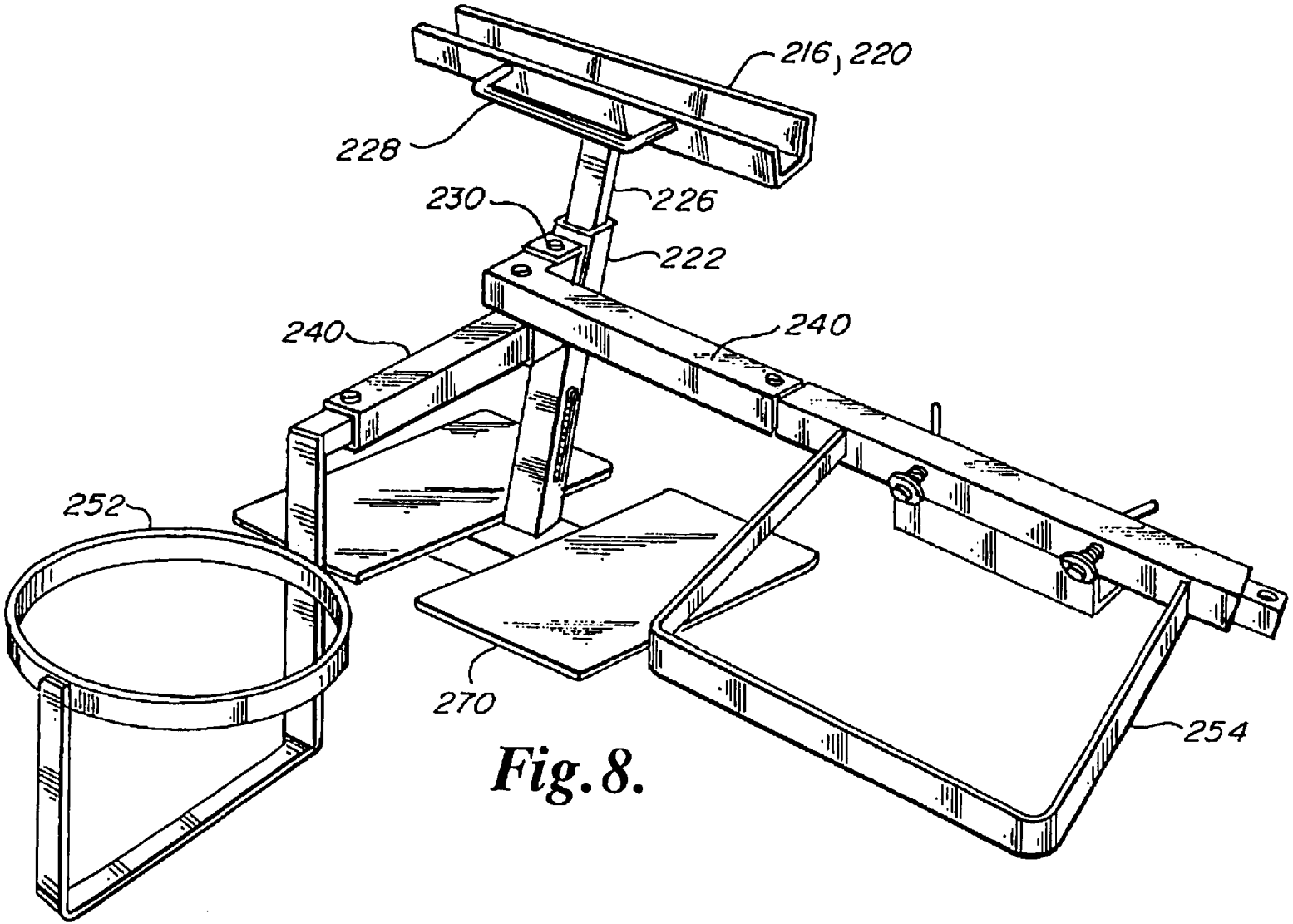
FIG. 8 is similar to FIG. 6, but without the ladder shown in phantom.

Preferably, the spring 18 contacts one of the engagement members 14, 16. A ram 26 then makes contact with the other engagement member, biased by the spring 18. Most preferably, the ram 26 and spring 18 are enclosed within a guide 22 having a central core 24, with the ram 26 reciprocating within the guide 22. A second guide 26, ram 22, and spring 18 may be employed, as shown in FIG. 3, or a single guide 26, ram 22, and spring 18 may be used, as shown in FIG. 8.

It will be seen that, to attach the apparatus 10 to the rungs R, it is merely necessary to compress the spring 18, by pushing the lower engagement member 14 toward the upper engagement member 16. One of the members 14, 16 is then slid against a rung, and the spring tension is released, allowing the other member 14, 16 to slide against the adjacent rung. To facilitate this operation, one of the members 14, 16 may have a handle 28.

Figure 4:
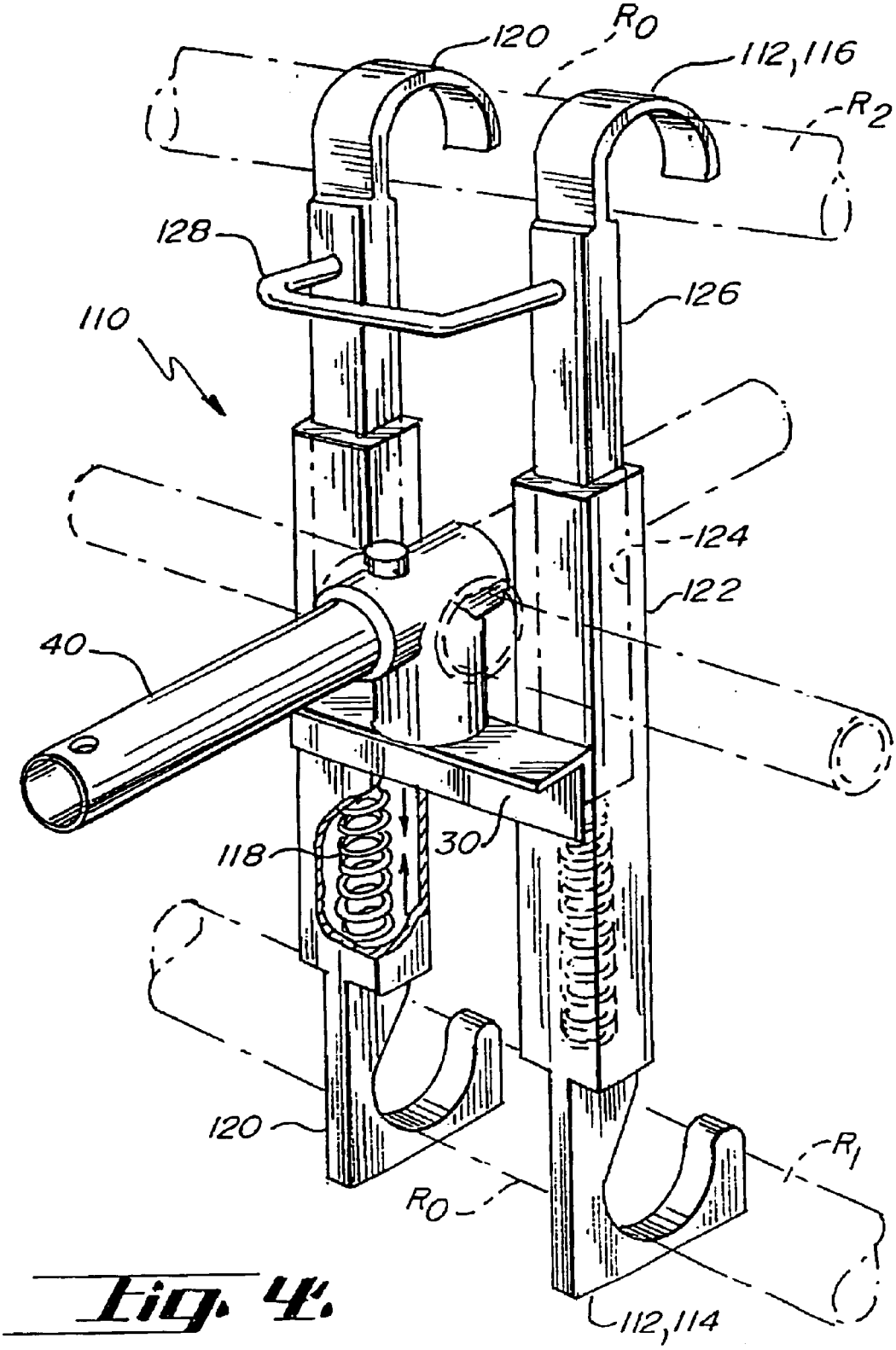
FIG. 4 is a perspective view of a second embodiment of the invention, with ladder rungs shown in phantom.
Figure 5A:
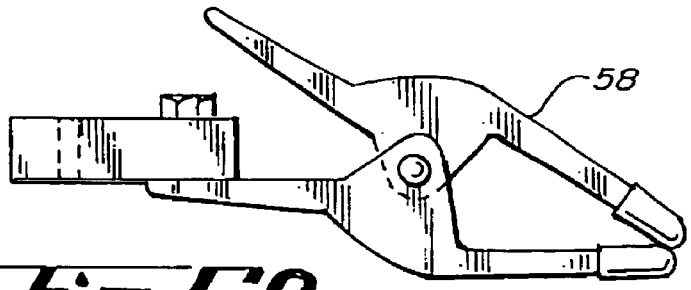
FIGS. 5A–5D are perspective views of various accessories that may be part of the invention.
Figure 5B:
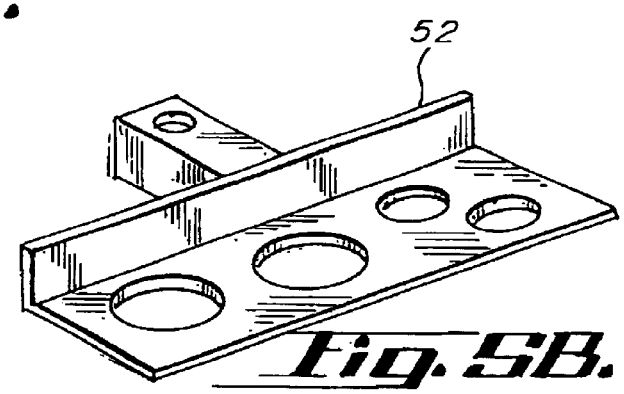
Figure 5C:
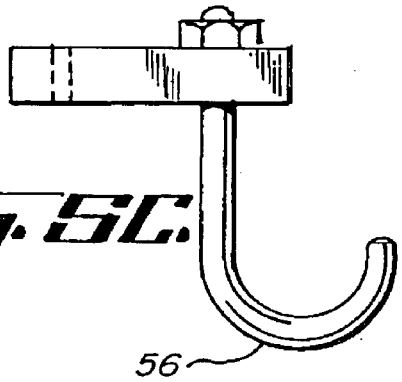
Figure 5D:
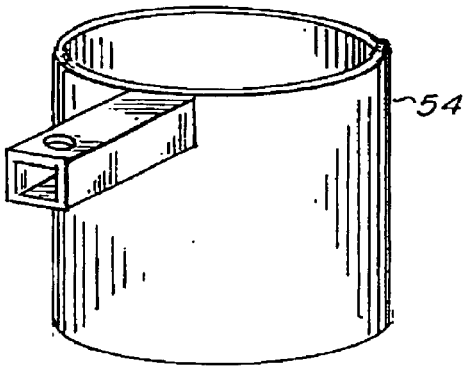

Turning to FIG. 4, details of the second embodiment are illustrated. The apparatus 110 further comprises a lower engagement member 114 adapted to engage ladder rung R1 and an upper engagement member 116 adapted to engage adjacent rung R2. The apparatus 110 also comprises a spring 118 biasing the lower engagement member 114 and the upper engagement member 116 against the rungs R1, R2.

The lower engagement member 114 and upper engagement member 116 preferably comprise hooks 120 adapted to contact the ladder rungs on the opposite sides RO.

Preferably, the spring 118 contacts one of the engagement members 114, 116. A ram 126 then makes contact with the other engagement member, biased by the spring 118. Most preferably, the ram 126 and spring 118 are enclosed within a guide 122 having a central core 124, with the ram 126 reciprocating within the guide 122. A second guide 126, ram 122, and spring 118 may be employed, as shown in FIG. 4.

It will be seen that, to attach the apparatus 110 to the rungs R, it is merely necessary to expand the spring 118, by hooking one of the members 114, under a rung, then pulling the upper engagement member 116 away from the lower engagement member 114. The spring tension is released, allowing the other member 116 to slide over the adjacent rung. To facilitate this operation, a handle 128 may be attached to one of the members 114, 116.

In each embodiment a frame 30 may be interposed vertically between the lower engagement member 14, 114 and the upper engagement member 16, 116. If more than one guide 22, 122 is used, the frame 30 serves to connect the guides together for parallel movement. The frame may also be used to assist in pulling the members 114, 116 apart in the second embodiment.

An arm 40 may be pivotally attached to the frame 30. A variety of interchangeable accessories 50 may be attached to the arm 40. FIGS. 5*a*–5*d* illustrate some of these accessories: a tool holder 52; a bucket 54, a hook 56, or a gripper 58. Other accessories are possible.

Figure 6:
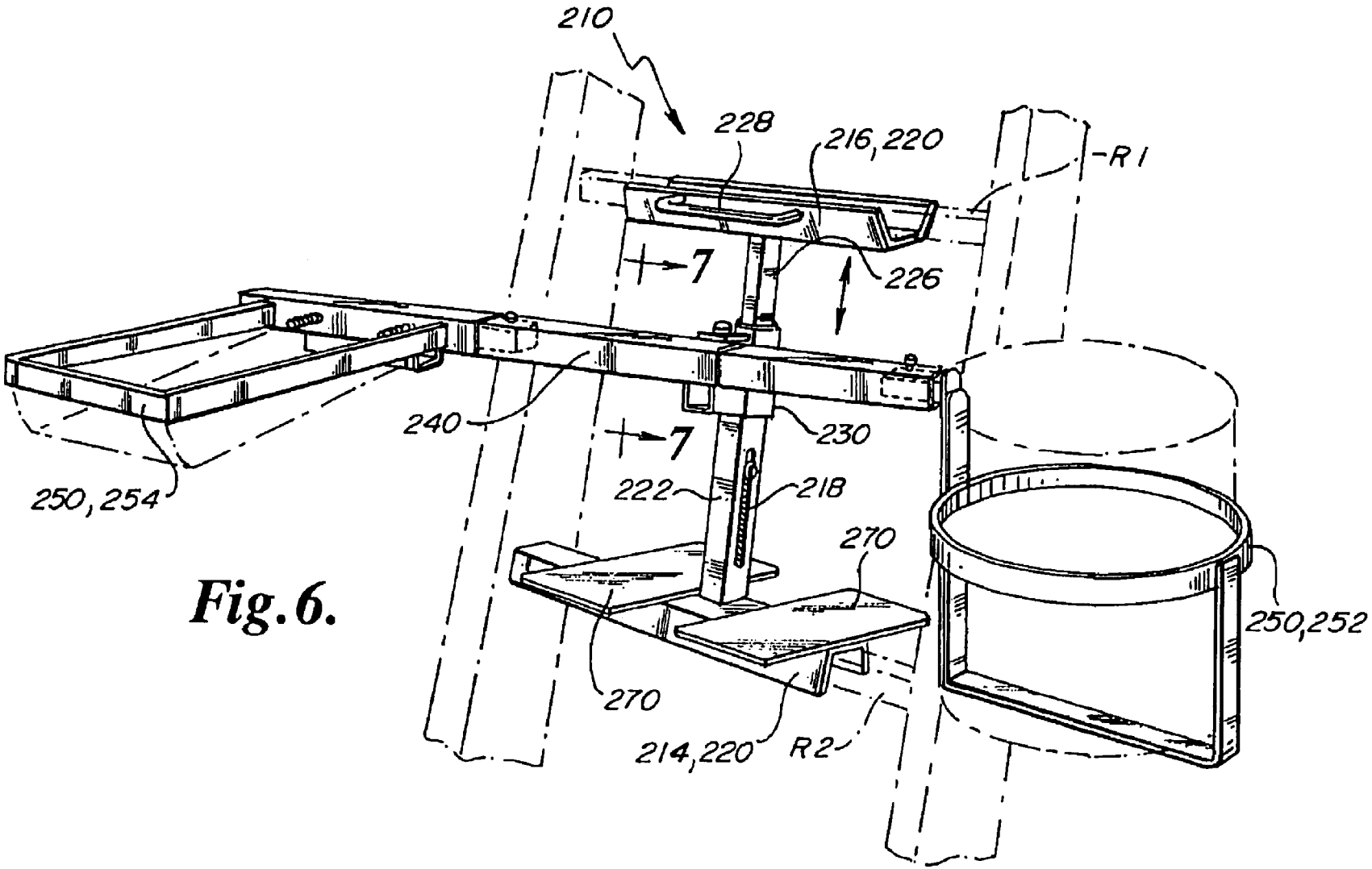
FIG. 6 is a perspective view of a third embodiment of the present invention, with the ladder shown in phantom.
Figure 7:
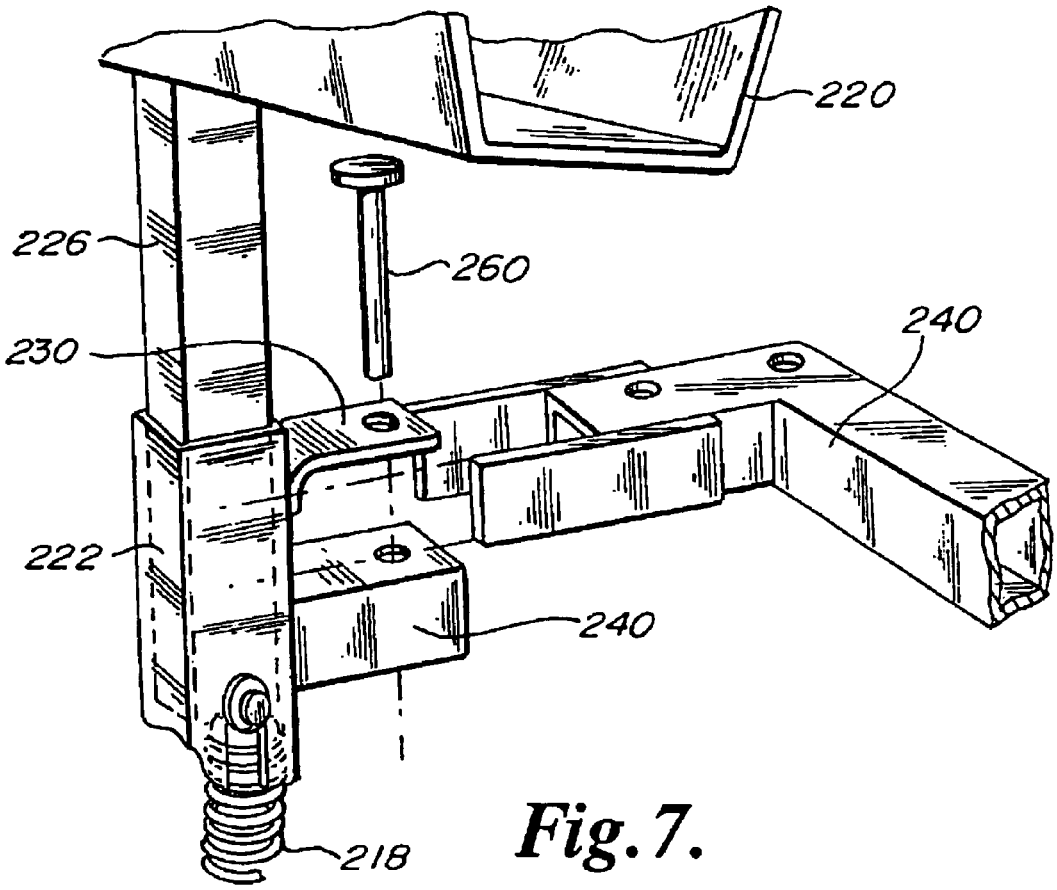
FIG. 7 is a detail of the third embodiment of FIG. 6.

A third embodiment of the invention is shown in FIGS. 6–8.

Details of the third embodiment 10 are shown in FIG. 6. The apparatus 210 further comprises a lower engagement member 214 adapted to engage ladder rung R2 and an upper engagement member 216 adapted to engage adjacent rung R1. The apparatus 210 also comprises a spring 218 biasing the lower engagement member 214 and the upper engagement member 216 against the rungs R1, R2.

The lower engagement member 214 and upper engagement member 216 preferably comprise U-shaped channels 220 adapted to contact the ladder rungs on the adjacent sides RA.

Preferably, the spring 218 contacts one of the engagement members 214, 216. A ram 226 then makes contact with the other engagement member, biased by the spring 218. Most preferably, the ram 226 and spring 218 are enclosed within a guide 222 having a central core 224, with the ram 226 reciprocating within the guide 222.

It will be seen that, to attach the apparatus 210 to the rungs R, it is merely necessary to compress the spring 218, by pushing downwardly the lower engagement member 214 onto rung R2 with handle 228. Then, upper member 216 is then slid underneath rung R1, and the spring tension is released, allowing the members 214, 216 to lock in place.

A frame 230 may be interposed vertically between the lower engagement member 214 and the upper engagement member 216. Preferably, the frame 230 is mounted on the guide 222, as shown in FIG. 7.

An arm 240 may be pivotally attached to the frame 230. A variety of interchangeable accessories 250 may be attached to the arm 240. FIGS. 6 and 8 illustrate some of these accessories: a bucket holder 252 and a paint tray holder 2. Other accessories are possible.

Most preferably, the arm 240 is removably attached to the frame 230. As shown in FIG. 7, the arm 240 may be attached to the frame 230 by a cotter pin 260. Any other attachment is also envisioned, such as screws, nuts, bolts, or other fasteners. A second arm 240 may also be attached to the frame 230.

The third embodiment 210 also preferably comprises a footrest 270 attached to the lower engagement member 214, as shown in FIGS. 6–8. The footrest 270 is most preferably attached to the lower engagement member 214 so that the footrest 270 is substantially perpendicular to the lower engagement member 214. A second footrest 270 may be added on the side of the guide 222 opposite the first footrest 270. The footrests 270 allow a person to have a more secure, more restful, stance on the ladder.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. Apparatus for attachment to the rungs of a ladder for securely holding a bucket and other accessories, the apparatus being readily detachable from the ladder rungs for movement along the ladder, the apparatus comprising:

(a) a lower engagement member adapted to engage a ladder rung;

(b) an upper engagement member adapted to engage an adjacent ladder rung;

(c) a spring connecting and the lower engagement member and upper engagement member, and adapted to bias the members against the respective ladder rungs; and (d) a frame interposed midway and vertically aligned between the lower engagement member and the upper engagement member and an aim pivotally attached to the frame.

2. The apparatus of claim 1, wherein the lower engagement member and upper engagement member each further comprise a substantially U-shaped channel adapted to contact the ladder rungs on adjacent sides of the ladder rungs.

3. The apparatus of claim 1, wherein the lower engagement member and upper engagement member each further comprise hooks adapted to contact the ladder rungs on nonadjacent sides of the ladder rungs.

4. The apparatus of claim 1, further comprising a guide engaging the lower engagement member, the spring being contained within the guide, and a ram reciprocating within the guide and biased by the spring.

5. The apparatus of claim 1, further comprising a footrest attached to the lower engagement member, the footrest being substantially perpendicular to the lower engagement member.

6. The apparatus of claim 1, further comprising a second guide engaging the lower engagement member, a second spring contained within the guide, and a second ram reciprocating within the guide and biased by the spring.

7. The apparatus of claim 1, further comprising accessories attachable to the arm.

8. The apparatus of claim 7, wherein the accessories are selected from the group consisting of: a bucket holder, a bucket, a hook, a gripper, and a paint tray.

9. The apparatus of claim 1, wherein the arm a detachable from the frame.

10. Apparatus for attachment to the rungs of a ladder for securely holding a bucket and other accessories, the apparatus being readily detachable from the ladder rungs for movement along the ladder, the apparatus comprising:

(a) a lower engagement member adapted to engage a ladder rung;

(b) an upper engagement member adapted to engage an adjacent ladder rung;

(c) a spring connecting and the lower engagement member and upper engagement member, and adapted to bias the members, against the respective ladder rungs wherein the lower engagement member and upper engagement member each further comprise a substantially U-shaped channel adapted to contact the ladder rungs on adjacent aides of the ladder rungs; and (d) a frame interposed midway and vertically aligned between the lower engagement member and the upper engagement member and an arm pivotally attached to the frame.

11. The apparatus of claim 10, further comprising a guide engaging the lower engagement member, the spring being contained within the guide, and a ram reciprocating within the guide and biased by the spring.

12. The apparatus of claim 10, further comprising a footrest attached to the lower engagement member, the footrest being substantially perpendicular to the lower engagement member.

13. The apparatus of claim 10, further comprising a second guide engaging the lower engagement member, a second spring contained within the guide, and a ram reciprocating within the guide and biased by the spring.

14. The apparatus of claim 10, further comprising accessories attachable to the arm.

15. The apparatus of claim 14, wherein the accessories are selected from the group consisting: of a bucket holder, a bucket a hook, a gripper, and a paint tray.

16. The apparatus of claim 10, wherein the arm is detachable from the frame.

17. Apparatus for attachment to the rungs of a ladder for securely holding a bucket and other accessories, the apparatus being readily detachable from the ladder rungs for movement along the ladder, the apparatus comprising;

(a) a lower engagement member adapted to engage a ladder rung;

(b) an upper engagement member adapted to engage an adjacent ladder rung, (c) a spring connecting and the lower engagement member and upper engagement member, and adapted to bias the members, against the respective ladder rungs wherein the lower engagement member and upper engagement member each further comprise hooks adapted to contact the ladder rungs on non-adjacent sides of the ladder rungs; and (d) a frame interposed midway and vertically aligned between the lower engagement member and the upper engagement member and an arm pivotally attached to the frame.

18. The apparatus of claim 17, further comprising a guide engaging the lower engagement member, the spring being contained within the guide, and a ram reciprocating within the guide and biased by the spring.

19. The apparatus of claim 17, further comprising a footrest attached to the lower engagement member, the footrest being substantially perpendicular to the lower engagement member.

20. The apparatus of claim 17, further comprising a second guide engaging the lower engagement member, a second spring contained within the guide, and a ram reciprocating within the guide and biased by the spring.

21. The apparatus of claim 17, further comprising accessories attachable to the arm.

22. The apparatus of claim 21, wherein the accessories are selected from the group consisting of a bucket bolder, a bucket, a hook, a gripper, and a paint tray.

23. The apparatus of claim 17, wherein the arm is detachable from the frame.

* * * * *